United States Patent [19]

Maul

[11] Patent Number: 5,015,496

[45] Date of Patent: May 14, 1991

[54] PROCESS FOR APPLYING A PROTECTIVE COATING TO HANDLES

[75] Inventor: Gary P. Maul, Worthington, Ohio

[73] Assignee: Vining Industries, Inc., Springfield, Ohio

[21] Appl. No.: 293,829

[22] Filed: Jan. 3, 1989

[51] Int. Cl.[5] ..... B05D 3/06

[52] U.S. Cl. ..... 427/54.1; 427/348; 427/369; 427/385.5; 427/434.7

[58] Field of Search ..... 427/434.7, 54.1, 348, 427/369, 385.5

[56] References Cited

U.S. PATENT DOCUMENTS

| | | | |
|---|---|---|---|
| 2,255,436 | 9/1941 | Olson | 427/474.7 X |
| 2,695,421 | 11/1954 | Amundson et al. | 427/434.7 X |
| 3,391,450 | 7/1968 | Bauer | 427/474.7 X |
| 3,672,974 | 6/1972 | Tomlinson | 427/474.7 |
| 3,733,216 | 5/1973 | Goldman et al. | 427/434.7 |
| 4,107,370 | 8/1978 | Ingraham | 427/434.7 X |
| 4,490,415 | 12/1984 | Imamura et al. | 427/434.7 X |
| 4,749,059 | 6/1980 | Jonnes et al. | 427/434.7X |

*Primary Examiner*—Bernard Pianalto
*Attorney, Agent, or Firm*—Jerome P. Bloom

[57] ABSTRACT

An system for protectively coating longitudinally extending rod and bar-like objects, exemplified in application to cylindrical objects such as wooden handles for brooms, brushes and mops, which prescribes effecting a powered, contained movement of handles to be coated in an immediately following series relation; directing the handles to and through an enclosed bath of a selected coating material; in process of the entry of a handle to the bath subjecting it to a movement thereof through a short closely encompassing sleeve which wipes its exterior surface free of dust and dirt, facilitating adherence of coating material thereto and coextensively therewith in its passage through said bath; subjecting the so coated handle to a powered movement thereof through a further short circumferentially and closely encompassing sleeve as it exits from this bath to produce thereby a smooth distribution of adherent coating material over the length of its exterior to form thereon a substantially uniform thin layer thereof and strip excess therefrom to remain in the coating chamber and at the same time, as the leading end of the handle exits from the chamber, substantially immediately subjecting it to air jets to spread coating material over such end in a substantially uniform layer and strip therefrom excess coating material, subjecting the handle immediately thereof to a final stripping, reduction of the thickness and smoothing of the applied coating and immediately curing the same during a continued movement of the handle.

10 Claims, 3 Drawing Sheets

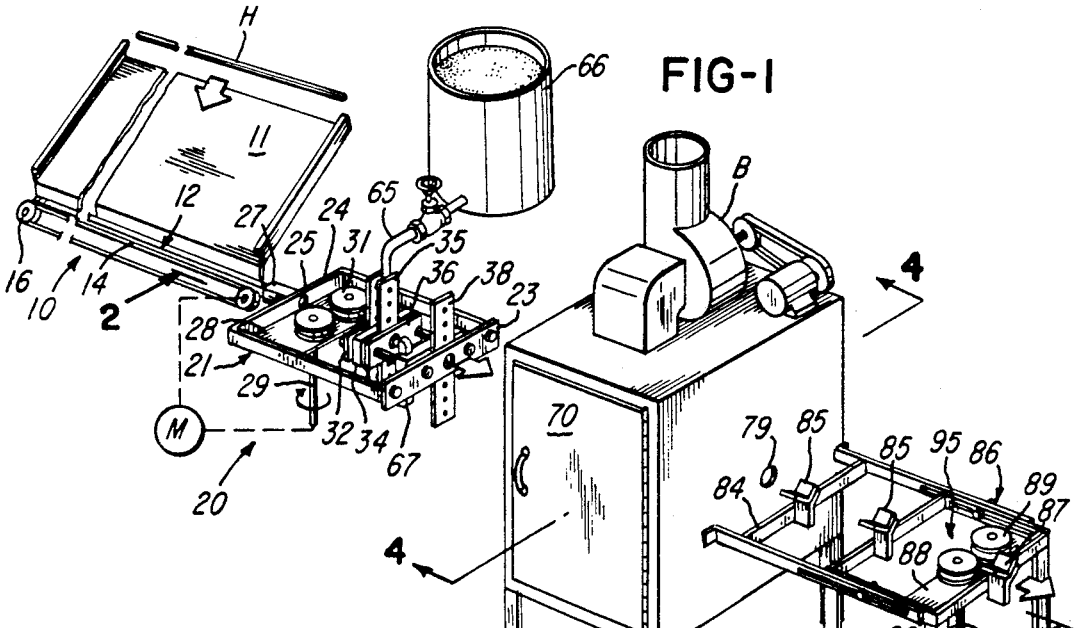
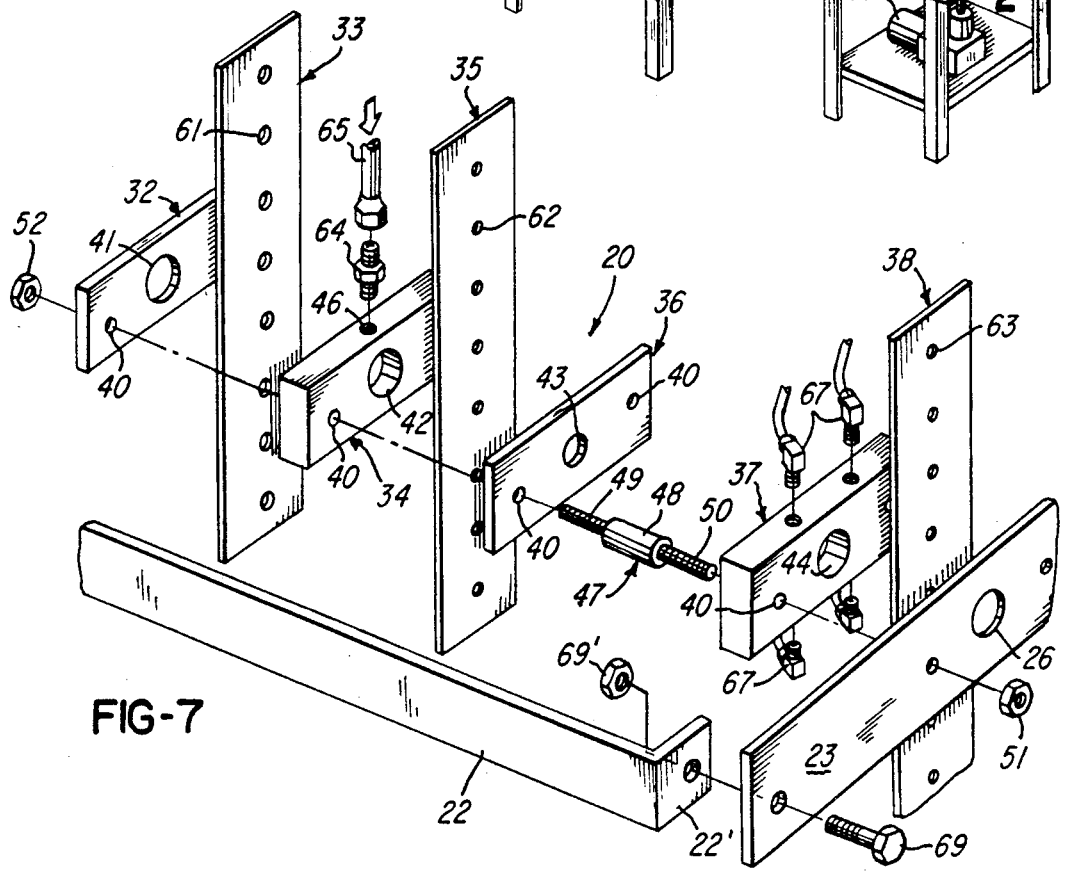
FIG-7

PROCESS FOR APPLYING A PROTECTIVE COATING TO HANDLES

BACKGROUND OF THE INVENTION

This invention relates to a new and highly improved method, system and apparatus for the application of a protective surface coating to rod and bar-shaped objects, elements and parts thereof. It has been proven in test to be highly advantageous in application to such objects, elements or parts as are dimensionally small in cross sectional area, longitudinally extended and cylindrically formed, particularly so in respect to wooden handles such as form a part of brooms, brushes and mops. In such cases the use of the present invention results in a handle having applied thereto, and virtually coextensive therewith, a strongly secured, durable and uniform thin coating of material which is preferably resin based and of a protective and/or decorative nature, as needs require. The present invention will therefore be herein described, by way of example only and not by way of limitation, in this context.

By contrast, prior art efforts to produce a protective or decorative exterior coating on a broom, brush or mop handle have exhibited less than satisfactory results and more often than not a lack of uniformity of the coating and in almost all cases the exposed extremity or extremities of the handle which has been coated has been left with bare or barely covered surface areas.

As compared with the state of the prior art, and particularly as referenced to the protective coating and surfacing of wooden handles, the process and practice of the method of the present invention as well as the system and apparatus thereof have proven to be most simplistic and economical to employ, more efficient and satisfactory in use and of a nature to contribute to the production of more durable and higher quality end products.

SUMMARY OF THE INVENTION

The present invention features a process for protectively coating longitudinally extending rod and bar-like objects which is particularly advantageous in application to cylindrical objects such as wooden handles for brooms, brushes and mops.

An illustrative mode of the practice thereof features the steps of effecting a powered movement of objects to be coated to and through an enclosed bath of a selected coating material, preferably one which is resin based, in an immediately following series relation; in process of the entry of each such object to the enclosed bath, wiping its exterior surface free of dust and dirt to facilitate adherence of coating material applied thereto coextensively therewith in its passage through said bath; and, in the process of exit of each so coated object from said bath, distributing such coating material as is adherent thereto as a result of its passage through said bath to form about the length of said object a substantially uniform thin layer of said coating and strip therefrom such of said adherent coating material which is excess, for use thereof in application to further of said objects in the course of their passage through said bath.

One of the preferred modes of executing the process of the invention for protectively coating longitudinally extending rod and bar-like objects such as wooden handles for brooms, brushes and mops comprises the steps of effecting a powered movement of handles to be coated in an immediately following series relation; directing the handles to and through an enclosed coating chamber; in process of the entry of each said handle to said chamber effecting its passage through means forming an axially short circumferentially and closely encompassing sleeve wiping its exterior surface free of dust and dirt to facilitate adherence of the coating material thereto in its passage through said chamber; in the process of the passage of each said handle through said chamber applying an acrylic resin to and coextensively of its exterior surface, in the exit of each so coated handle from said chamber effecting its passage through a further axially short circumferentially and closely encompassing sleeve to produce a smooth end to end distribution of the applied adherent acrylic resin on said handle, in a substantially thin uniform adherent layer thereof; and as the leading end of each said handle moves outwardly from said further sleeve distributing the acrylic resin which has adhered thereto in its passage through said chamber to produce a thin layered covering thereof coextensive therewith and in the process thereof remove excess resin therefrom for reuse on other handles.

A preferred mode of practice of the process of the invention for the application illustrated is characterized by moving said handles to and through said bath of coating material at a substantially uniform speed with the handles following one another in a substantially end to end relation and inducing an increase in speed of the leading handle and an abrupt advance in the rate of the powered movement thereof immediately of the final phase of its coating procedure.

As will be seen this increase in speed of the powered movement of the leading handle facilitates the most effective and satisfactory completion of the coating process being applied to the following handle.

An embodiment of the apparatus and system of the present invention, demonstrated herein as used in the protective coating of longitudinally extending rod and bar-like objects in the nature of cylindrical, relatively small diameter, wooden handles for brooms, brushes and mops, comprises means defining an enclosed coating chamber having an entrance thereto and an exit therefrom which are relatively closely spaced, the distance between said entrance and said exit corresponding to only a segment of the length of the handles to be passed therethrough; means for effecting a powered movement of the handles to be coated to, through and from said chamber in a successive immediately following series relation; means being provided immediately of the entrance to said chamber to closely encompass and wipe the length of each handle free of dust and dirt to facilitate adherence of coating material applied thereto in its passage through said chamber, to and coextensively of its exterior surface. Means are provided immediately of the exit from said chamber to distribute the coating material applied to and remaining adherent to each handle as a result of its passage through said chamber to produce thereon a smooth thin layer of said coating material which is coextensive with its length and at the same time strip therefrom such of the adherent material as is excess, such excess being salvaged thereby for its reuse.

In a preferred embodiment of this system and apparatus of the invention, said means provided immediately of the exit from said chamber further include means for directing jets of a gaseous fluid such as air to the leading end of each handle as it advances beyond said exit to spread such coating material as is adherent thereto to cover it with a substantially uniform layer thereof and at the same time strip excess coating material therefrom to salvage such excess.

Alternatively the means immediately of the exit from said chamber to distribute the coating material applied to and remaining adherent to each handle during its passage through and from said chamber to produce on each said handle a smooth thin layer of said material over and coextensive with its length may further comprise means to spread such coating material as is adherent to said leading end to cover said leading end and additional means immediately of the last mentioned means to subject the coating applied to the handle to a further smoothing and adjustment thereof as the leading end of the handle advances from said further sleeve.

A system and apparatus per the present invention, the illustration of which is schematic in part, most preferably includes a curing station immediately of the coating station for the objects being processed which is so constructed and arranged that the leading end of each handle will in exit from the coating station, enter and move through the curing station while the following portion of its length is in part within and in part yet to enter the coating station.

A preferred format of a curing station per the invention is one defined by an enclosed chamber having aligned entrance and exit openings and, within its interior, paired diagonally opposed ultra-violet reflector lamps which are parallel to and equi-distant from the longitudinally extending objects passed through said chamber for the curing thereof.

The invention system and the practice of the process thereof is capable of producing a most effective, most satisfactory and most durable protective and/or decorative coating of objects of the type described wherein the depth of the protective layer of the applied coating material will be as little as 0.0015 to 0.002" and eminently satisfactory.

It will also be seen from the following more detailed disclosure of the illustrated emdbodiment of the invention that it comprises a feed station, a compound coating station, a curing station and a control and discharge station. As shown, these stations are disposed in an aligned, series related, closely following relation and structurally and functionally related to produce in the use thereof a very thin but highly protective and/or decorative coating on longitudinally extending handles for brooms, brushes and mops.

The feed station disclosed features means defining a longitudinally extended channel the sides of which include means operative on the deposit of a handle therein to move such handle, at a selected uniform speed, into the coating station in the process of which to provide it with further support which maintains its substantially precise alignment during the coating procedure to which the handles are subjected. Immediately of its advancement into the coating station each handle, in succession, is advanced into and through a coating chamber, in the course of which it is subjected to a progressive application of a selected coating material, preferably an acrylic resin in the present exemplary illustration.

A preferred format of a coating station comprises means defining a coating chamber a portion of which defines an entrance thereto which in the advancement therethrough of each object to be coated presents to said object a closely encompassing sleeve the form and shape of which renders inherently effective to wipe the length thereof free of dust, dirt and adherent foreign particles prior to its movement through said chamber. Means defining an exit from said chamber provides, at least in part, a sleeve which closely encompasses the circumference of the object as it moves from said bath to limit and spread the coating material adherent to said object as a result of its movement through the bath to a smooth, substantially uniform thin layer thereof and in the process leaves the excess of the coating material in said chamber.

A most simplistic structure defining a coating station per one embodiment of the present invention comprises three successively disposed plates having central apertures. Interposed between successively adjacent faces of said plates is a strip of elastomer the length of which is characterized by a series of small, longitudinally spaced, equidistant apertures one of which is coaxially aligned with the central apertures in the plates, which are clamped together to sandwich said strips therebetween. Opposed portions of the elastomer strips which are imperforate save for said one aperture, together with the surface peripherally bounding the central aperture of the central of said plates define a coating chamber the entrance to and exit from which is defined by these apertures. By virtue of the material bounding these small apertures, which material is resilient, flexible and has a degree of stretchability, they are enabled to readily accommodate a powered advance therethrough of longitudinally extending objects the cross sectional dimension of which is somewhat greater than their dimension and in the process thereof the material rimming the apertures will in each instance form a sleeve about the body of the object moving therethrough which serves in the one case to wipe the body of the object free of dirt and dust and in the other to achieve a control of the coating material carried by and adherent to the exterior surface thereof to produce a thin coating of the object which has a limited depth and a smooth finish coextensive with its length. In a preferred format of the system and apparatus of the invention, immediately of the exit of a coated object from the coating chamber the lead end thereof is subjected to the application of jets of gaseous fluid to substantially simultaneously strip therefrom excess coating material and substantially uniformly distribute a limited layer thereof over and coextensive therewith, subsequent to which there is a powered advance of the object to and through an immediately following curing chamber wherein as successive portions of the length of the object pass therethrough the essentially uniform smooth coating applied thereto is cured and set coextensively therewith. As this object passes outwardly of and advances beyod the curing chamber it is directed to and between a pair of peripherally grooved rollers which not only provide power for the discharge of the handle as a finished product but apply thereto an increased speed of the movement thereof which in discharge is reflected by an inherently induced spacing of this object from the following object, facilitating thereby an optimal surfacing of the lead end of the immediately following object which is then being coated.

A primary object of the invention is to provide means and a method for use in effecting a highly improved coating of rod or bar-like elements, particularly advantageous in application to relatively small diameter cylindrically configured devices such as, for example, handles for brooms, brushes and mops, which as compared to prior art practice are more economical to employ, more efficient and satisfactory in use and unlikely to produce damage to the devices to which they apply in the processing thereof.

Another object is to provide an improved installation for use in producing an improved coating of longitudinally extending rod or bar-like elements, particularly cylindrically formed elements and parts of such nature which is structurally most compact, most economical to fabricate and occupies a very small space as related to its performance and production capabilities.

A further object is to provide such an installation featuring a new and improved construction for a coating chamber.

An additional object is to provide such an installation with both a new and improved curing chamber.

Another object of the invention is to provide a new and improved installation and most effective functional interrelation of a coating chamber and a curing chamber.

An additional object is to provide an improved installation for use in producing an improved coating of longitudinally extending rod or bar-like objects, particularly cylindrically formed wooden elements such as handles for brooms, brushes and mops characterized by feeding, coating, curing and control and discharge stations which are in the form of compact structures arranged in a close successively following series relation which functionally interrelates to provide an assured direct line continuous linear movement of the objects to be processed and in the course of such movement the achievement of a clean and clearly defined most secure attachment of a very thin durable coating which is substantially uniform throughout its length.

Another object is to provide a method for use in effecting a highly improved quality of coating of rod or bar-like elements, particularly advantageous in application to relatively small diameter cylindrically configured objects such as, for example, handles for brooms, brushes and mops having the characteristics, the inherent facility of usage and the beneficial advantages of that practice thereof which is herein set forth.

A further object is to provide new and highly improved system, apparatus and installation for use in effecting an improved quality coating of rod or bar-like objects and components thereof, particularly advantageous in application to relatively small diameter cylindrically configured devices such as, for example, handles for brooms, brushes and mops possessing the advantageous structural features and the inherent characteristics and the means and mode of use herein described.

With the above and other incidental objects in view as will more fully appear in the specification, the invention intended to be protected by Letters Patent consists of the features of construction, the parts and combinations thereof and the mode of operation of the system and apparatus and the process practiced in use thereof as herein described or illustrated in the accompanying drawings, or their equivalents.

Referring to the drawing wherein is shown, by way of example, one but not the only form of embodiment and practice of the present invention and component parts thereof, FIG. 1 is an exploded view of a system and apparatus per the present invention which is in part schematically illustrated and applied in this instance to the coating of longitudinally extended handles, in particular those handles which form parts of brooms, brushes and mops;

FIG. 7 is an exploded view of the coating station of the illustrated embodiment.

Like parts are identified by like numerals throughout the drawings.

Figures 2, 3:
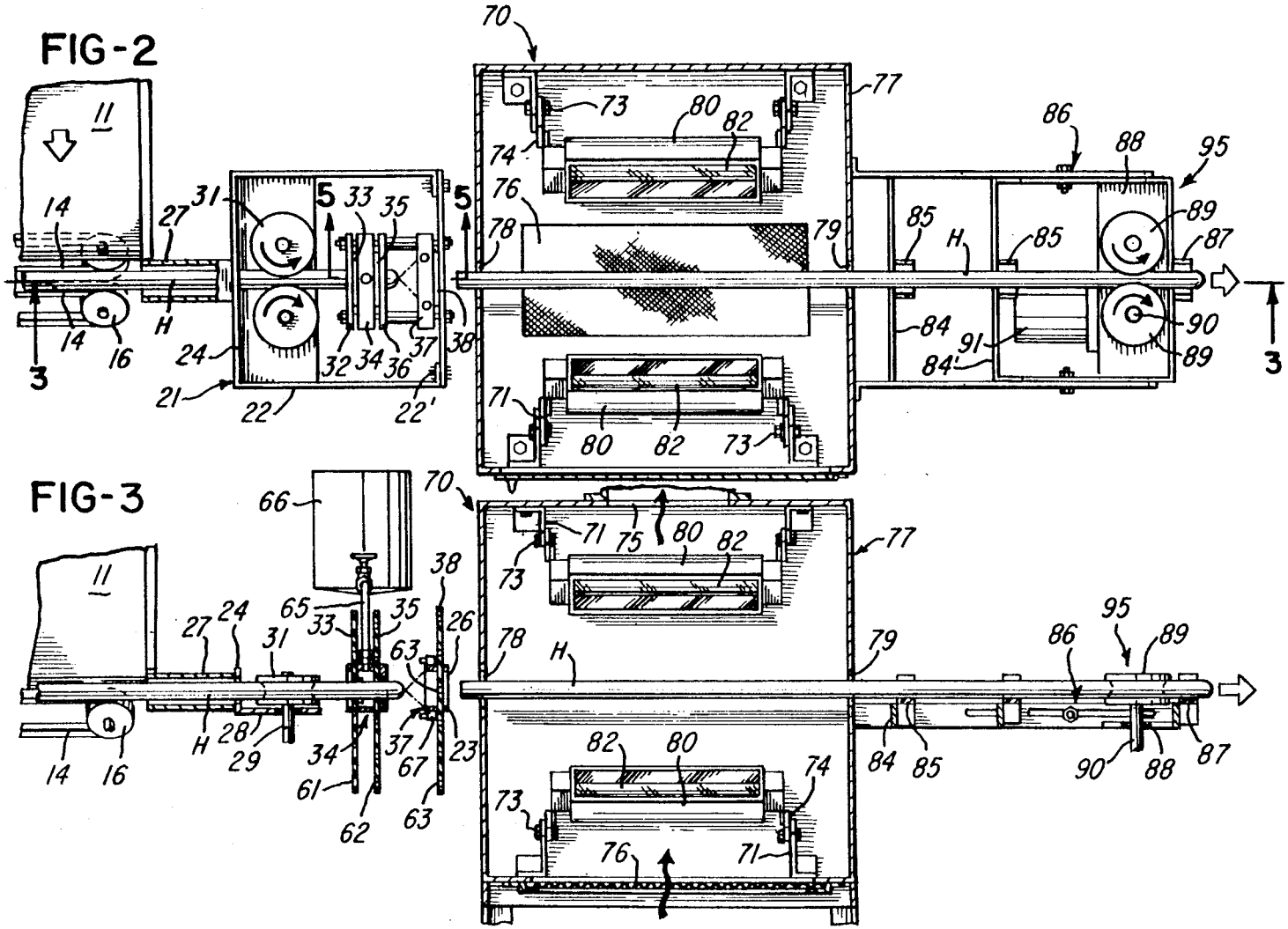
FIG. 2 is a sectional view taken on line 2—2 of FIG. 1.
FIG. 3 is a sectional view taken on line 3—3 of FIG. 2.

The illustrated embodiment of a system and apparatus per the present invention and the practice of the process thereof, shown as applied to the coating of wooden handles H used for brooms, brushes and mops, comprises means defining a feed station 10, a compound coating station 20, a curing station 70 and a control and discharge station 95. These stations are in an aligned, series related, closely following relation.

Diagrammatically demonstrated in the drawings, as an adjunct thereto, is a supply system 11 which provides that the handles H to be coated are directed to the feeding station 10 from a hopper by way of a downwardly inclined feed chute 11 wherein the handles are vertically stacked in a parallel transversely extending relation (not shown). As thus disposed, handles H are each oriented and maintained in that position it must assume at the lower end of the chute to drop therefrom into a longitudinally extending channel structure 12 which is positioned parallel thereto, in a direct alignment therewith, and defines the feeding station 10. Conventional control means suitably provided in connection with the chute are so related to the handles to insure that the lowermost handle therein at any given time does not drop therefrom until the preceding handle has fully cleared the underlying channel structure 12. Neither the details of the chute nor the controls which interrelate with the handles are herein illustrated or further described since these are well known and understood in the material handling art and do not per se constitute the present invention.

The channel structure 12, which is suitably supported to position above and in an elevated, spaced parallel relation to an underlying base surface, comprises upwardly divergent longitudinally extending inner side surfaces which in transverse section define a shape substantially that of a truncated V. The length of each of these inner side surfaces is defined primarily by what may be considered the upper run of an endless belt 14 which bears on and moves about a pair of longituinally spaced small diameter pulleys 16. Each pulley 16 is constructed to define in the outer periphery thereof a substantially V-shaped groove in which the belt applied thereto securely seats as it moves thereabout in the running thereof. A motor M is suitably connected to one of the pulleys 16 of each pair to produce a powered rotation and a simultaneous drive thereof and correspondingly a simultaneous concurrent powered drive of the belts 14 as and when the motor is energized.

In the example illustrated the length of the channel defined by structure 12, as related to that of the handles to be coated, is such that a handle received thereby will nest therein, substantially coextensive therewith, in bearing relation to its upwardly diverging sides which are defined by the upper runs of belts 14. When motor M is energized, the direction of rotation of the powered pulleys 16 and the concurrent tandem drive of belts 14 will be such that the handle then within the channel will be advanced thereby in a smooth continuing fashion in the direction of, to and, as will be seen, by belts 14 outwardly of the feed station 10 and directed into and through the coating station 20 which is in an immediately following relation. In accordance with a preferred practice of the process of the present invention the advancement will be at a selected uniform speed.

Coating station 20 is rimmed by an open rectangular frame 21 which is positioned horizontally at substantially the same elevation as, and in coaxial relation to, channel structure 12. Frame 21 in this instance comprises a longitudinally extended strip 22 of rugged plate metal which has been bent into a rectangular U-shape, identical short portions 22' of the ends of the legs of which are bent inwardly thereof and perpendicular thereto to dispose in a longitudinally spaced co-planar relation. As seen in FIGS. 1 and 7, strip 22 is oriented on its side and its vertical depth is determined by the lateral extent of the strip of metal of which it is formed. The fourth side of frame 21 is formed of a complementary strip 23 of the same metal which bridges the respective end portions 22' of strip 22 and has its end portions respectively disposed over and releasably but securely connected in an overlying relation thereto by means of applied bolts 69 and nuts 69' in a manner well evidenced in FIG. 7 of the drawings.

Base portion 24 of the U-shaped strip 22 is provided with a central aperture 25 which positions in a substantially coaxial alignment with channel 12 and has a diameter which in any case will be larger than that of such handles as may be dropped therein for the advancement thereof to coating station 20. Also in coaxial alignment with aperture 25 is a like aperture 26 which is located in and centrally of strip 23, which defines that side of frame 21 most remote from channel 12. Integrated with the outer surface of base portion 24 of strip 22, in rimming relation to aperture 25, is a short tube 27 which projects outwardly therefrom, perpendicular thereto and coaxial therewith to a point immediately of the adjacent end of channel 12.

A relatively narrow metal plate 28 is integrated with and in a transversely bridging relation to a portion of the bottom of frame 21, along the base 24 of strip 22 to which it is joined. Plate 28 mounts along the length thereof and equidistant from its center, within the limits of frame 21, a pair of perpendicularly related shafts 29 and 30 which are in a plane parallel to that of base 24. The upper limit of each of these shafts mounts an identical roller 31 having a substantially V-shaped groove directed inwardly and circumferentially of its outer periphery. Rollers 31 are in an equidistant closely spaced relation to plate 28. The space defined between rollers 31 is in a direct coaxial alignment with aperture 25. Suitable means are provided to enable the adjustment of such spacing so it will conform and be complementary to the circumferential configuration and diametral dimension of the handles to be processed at any given time. As illustrated schematically in FIG. 1, a motor M is connected in driving relation to shaft 29 and correspondingly to the roller 31 which is fixed to its upper end for rotation therewith. In the example illustrated the other roller 31 is an idler roller.

Accordingly, when motor M is energized it will simultaneously energize and drive rollers 16 and belts 14 as previously described and at the same time energize shaft 29 and the roller 31 in connection therewith. As will be seen, due to the spacing and positioning of the upper runs of belts 14, the containment therebetween of each handle H received in channel 12, the direction and uniform speed of their movement and the complementary spacing and drive of rollers 31 (at the same uniform speed in accordance with the preferred practice of the process of the invention) which receive and grip therebetween each handle substantially immediately of the commencement of its advance from channel 12, there occurs a supplemented compound, balanced, controlled movement and support of each handle for the duration of its passage to and through the coating station 20.

The principal elements of coating station 20 which successively follow rollers 31 within frame 21 are very compactly assembled in series related successively abutted relation and the composite thereof is backed by, mounted in connection with and clamped to portion 23 of frame 21 by bolts 47 and nuts 50 (FIG. 7). These elements, in succession, comprise a thin, relatively small, rectangularly configured plate 32; a relatively narrow, elongate sheet-like strip 33 of a flexible, resilient rubber-like material, preferably a white elastomer; a plate 34 having a peripheral dimension and configuration identical to that of plate 32 but evidencing a thickness substantially greater than that of plate 32; a further relatively narrow sheet-like strip 35, the material, peripheral configuration and orientation of which corresponds to that of strip 33; a plate 36 the peripheral configuration, dimension and thickness of which corresponds to that of plate 32; a plate 37 that has a peripheral configuration, dimension and thickness that substantially corresponds to that of plate 34 and an additional relatively narrow elongate sheet-like strip 38, the material, peripheral dimension and orientation of which corresponds to that of strips 33 and 35.

Each of plates 32, 34, 36 and 37 has therein a central aperture, respectively designated 41, 42, 43 and 44, and two additional small apertures 40 which are in line with its central aperture and respectively positioned to each of its opposite sides and equidistant therefrom. The diameter of each of apertures 41, 42, 43 and 44, like aperture 26 in strip 23 of frame 21, is made larger than the diameter of the handles to be coated. However, in the preferred embodiment illustrated apertures 41, 43, 44 and 26 have essentially the same diameter while the diameter of aperture 42 is smaller.

The longitudinal extent of the relatively narrow elastomer strip 33 is provided with a plurality of series related, longitudinally and equidistantly spaced, laterally centered, apertures 61 the diameter of which in comparison to that of apertures 41 and 42 is quite small. Strip 35 is identically formed save that the diameter of its apertures 62, which correspond to the apertures 61 of strip 33, is smaller for purposes which will soon become obvious. On the other hand strip 38 is in this case identical to strip 33 in all respects, its apertures 63 being of the same size as apertures 61.

There are two bolts 47 the body of each of which is headless and comprised of a smooth intermediate portion 48 of its length which exhibits its largest diameter and end portions 49, 50 which are threaded and relatively reduced in diameter to form thereon two oppositely facing annular shoulders which are in planes which are parallel and perpendicular to its central axis. Note that diameter of the bolt end portions 49 and 50 are complementary to that of apertures 40.

Accordingly, the assembly of the principal elements of the coating station 20 can be easily effected. For example, plate 37 can be simply placed in facing laterally centered relation to strip portion 23 of frame 21 with strip 38 sandwiched therebetween and in laterally centered relation to both with its length extending perpendicular thereto. In the process thereof strip 38 is so positioned to have one of its apertures 63 coaxially align with the apertures 44 and 45 of plate 37 and strip 23, whereupon end portions 50 of bolts 47 may be applied to and through apertures 40 of plate 37 and, in obvious fashion, to and through the corresponding apertures 40 in strip 23 which are aligned therewith to have nuts 51 threadedly engaged over their outwardly projected extremities to bring the annular shoulders at the base ends of bolt portions 50 of the applied bolts 47 into face abutted clamped relation to the surface of plate 37 remote from strip 23 while at the same time nuts 52 clamp against the outermost surface of strip 23. At this point elements 37 and 23 are rigidly interconnected, with element 38 fixedly though releasably sandwiched therebetween, and at the same time fixedly mounted to one end of bolts 47.

The balance of the primary elements of the coating station 20 are applied over the end portions 49 of bolts 47 and fixedly mounted thereto and to the strip 23 of frame 21 in similar manner. More particularly, plates 36, 34 and 32 are successively applied over bolt end portions 49, the same being accommodated by the apertures 40 thereof. In the process the surface of plate 36 most remote from rollers 31 is established in face abutted relation to the radial shoulders defining the base ends of bolt end portions 49; central apertures of these plates are coaxially aligned with each other and aperture 44 of plate 37; strips 35 and 33 are positioned in alignment with strip 38 and respectively sandwiched between plates 36 and 34 and 34 and 32 to position an aperture of each thereof in direct alignment with the other and the aperture 63 of strip 38 which is in coaxial alignment with aperture 44 of plate 37 as well as aperture 26 of strip 23. All these further applied elements are fixed in their required functionally related positions on application of nuts 52 to the extremities of end portions 49 of bolts 47 which project outwardly of the face of plate 32 most remote from strip 23. Irrespective of which direction or by what means the illustrated elements of the coating station are brought together in a manner such as described, the foregoing evidences the most simplistic and economical nature of the structure of a coating station and the assembly thereof in accordance with the present invention.

As becomes self evident on inspection of the drawings, particularly FIG. 7, the very compact assembled interrelation of the plates 32, 34 and 36 and the successively interposed strips 33 and 35 establish within the limits thereof a relatively short cylindrically configured coating chamber the peripheral boundary is provided by that surface which bounds the central aperture 42 in plate 34 and the sides of which are defined by laterally centered portions of the lengths of strips 33 and 35. At the same time the entrance to this chamber is defined by an aperture 61 of strip 33 and the exit therefrom by an aperture 62 of strip 35, the strips being secured to plate 34 and clamped in place between side plates 32 and 36 which together therewith mount within the axial limits of end portions 49 of bolts 47 and are clamped between shoulders defined at their inner limits by the central portions 48 of the length of the bolts and nuts 52 applied over their outer extremities.

Directed through the center of and perpendicular to the uppermost surface of plate 34 is a vertically oriented tapped throughbore 46 the radially innermost end of which opens to the coating chamber. A tubular adapter 64 one end of which is screwed into the radially outermost end of bore 46 has the outermost end thereof coupled to one end of a delivery line 65 the opposite end of which opens into the bottom of a container 66 the contents of which will be that material by which the handles to be processed will be coated. In the particular application of the invention herein illustrated this material is an acrylic resin. A valve shown in FIG. 1 to be interposed in the delivery line 65 may in the processing of the handles be selectively manually operated or arranged with suitable controls to produce automatic filling of the coating chamber on initiating a coating operation and maintain a required level of the acrylic resin within the coating chamber during any period the apparatus of the invention is required to remain in operation.

Figure 5:
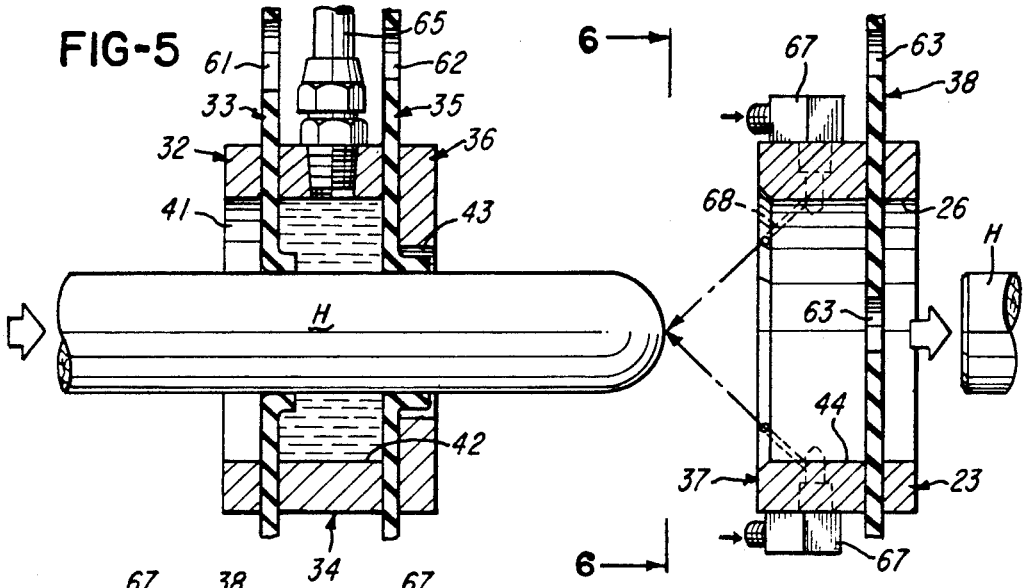
FIG. 5 is a sectional view taken on line 5—5 of FIG. 2.
Figure 6:
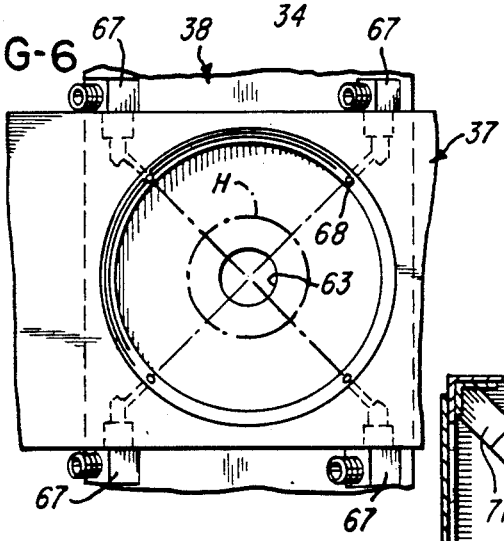
FIG. 6 is a view taken on line 5—5 of FIG. 2.

Plate 37 has two tapped bores directed inwardly of and perpendicular to the uppermost portion of its outer peripheral surface at locations which are equidistant from the center of its aperture 44. A similarly applied pair of tapped bores is directed inwardly of and perpendicular to its lowermost surface. The entrance end of aperture 44 in plate 37, which is in a relatively closely following, axially spaced, relation to aperture 43 in plate 36, is conically expanded to produce thereon an inwardly convergent surface. Directed inwardly of this convergent surface at each of four points are four additional bores 68 which are arranged in a circularly, substantially equidistantly spaced relation. Each of the bores 68 is arranged to intersect a different one of the four aforementioned tapped bores, form an extension thereof and produce a through passage in plate 37 the entrance to which opens from the outer peripheral surface of the plate and the exit from which is at the convergent surface which rims the entrance end of its central bore 44. Applied to the entrance end of each of said through passages in plate 37 is a tubular adapter 67, connected to one end of which is a delivery tube the opposite end of which is connected to a source of air under pressure. The construction and arrangement so provided produces, during the operation of the coating system herein illustrated, a simultaneous flow of air under pressure to and through the four flow passages defined in the body of plate 37 which issues from the conically convergent narrow surface at the entrance to aperture 44 in the form of four jets. These jets are directed outwardly from and upstream of the entrance to aperture 44 to conically converge at a point well in advance thereof in the manner demonstrated in FIG. 5 of the drawings. The purpose and effect thereof will be further described.

Curing station 70 is defined within a hollow rectangular box-like cabinet, one side wall of which has an aperture 78 defining an entrance thereto for the handles which have been coated and the opposite side wall of which has an aperture 79 coaxially aligned with aperture 78 defining an exit therefrom for those handles which are in process of being cured. This cabinet is positioned immediately of and in a very closely spaced relation to strip 23 of frame 21 to position its apertures 78 and 79 in a direct coaxial alignment with aperture 26 and correspondingly with the coaxially aligned apertures in the elements 38, 37, 36, 35, 34, 33 and 32. As will be seen in FIG. 1, the cabinet has a suitable base placing it in that elevated position required to properly position its entrance and exit apertures 78, 79 as just described.

Figure 4:
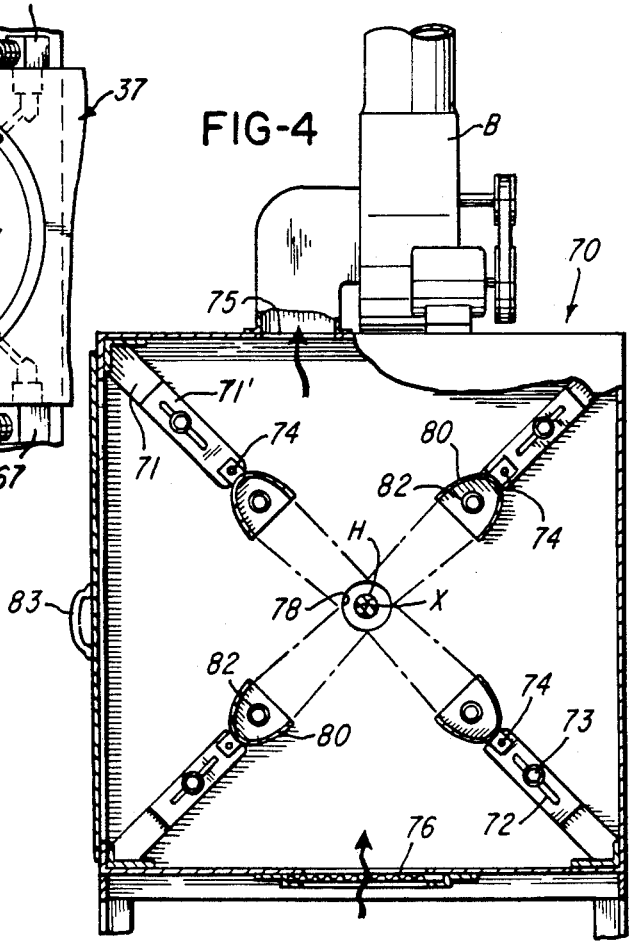
FIG. 4 is a sectional view taken on line 4—4 of FIG. 1.

As seen in FIGS. 2–4 of the drawings, positioned within the interior of the cabinet defined in the curing station 70 and extending lengthwise thereof at a location centered between its side walls which respectively include the entrance aperture 78 and the discharge aperture 79 and equidistantly spaced from a line through the curing station which joins the centers of these apertures are four ultra-violet lamps 82. Each lamp 82 is nested in and backed by a reflector 80 which is elliptical in cross section. As shown in FIG. 4 the lamps 82 and their reflectors 80 are arranged in diagonally related pairs. Each reflector has in connection therewith two perpendicularly related, parallel, rearwardly projecting mounting plates, one to each of the opposite ends thereof, which plates are each pivotally connected by a pin 74 to the outer end of an axially adjustable bracket 71. The base ends of each pair of brackets 71 which commonly mount a reflector 80 and an exposed lamp 82 are anchored at the outer ends thereof, in each case, to a different corner of the curing cabinet to position the lamps 82 equidistant from the entrance and exit sides of the cabinet and at locations to be parallel and in outwardly spaced relation to any handle directed to and through the curing station (FIG. 4). As seen in FIG. 4, each bracket 71 is comprised of a base and a slidably adjustable outer end portion, the latter of which has a longitudinally extended slot 72 within and short of the length thereof, through which slot a bolt 73 is applied to conventionally clamp the outer end portion of the bracket to its base portion in any selected position of axial adjustment with respect thereto that may be required for any given application of the lamps 82. The curing cabinet has an opening in it bottom which is bridged by an air filter 76 and a directly aligned aperture at its top defining an outlet communicating with the inlet of a blower B. The operation of the latter is designed, as shown, to draw clean air to and through the curing station and insure the presence of clean air within the curing station during the entire curing process to which it is applied.

The control and discharge station 95 is located in a closely spaced immediately following relation to the curing station 70. As illustrated in FIGS. 1–3, the primary elements of station 95 are mounted on a tiered platform the top of which is defined by an open rectangular frame bridged in part by a relatively narrow, horizontally oriented metal plate 88 which is integrated therewith. Plate 88 mounts a pair of perpendicularly related shafts, each mounting at the upper end thereof, and at the same level, an identical roller 89 having a substantially V-shaped groove directed inwardly and circumferentially of its outer periphery. Rollers 89 are positioned immediately above the open rectangular frame in an equidistant closely spaced relation to plate 88.

The space defined between the rollers 89 is in a direct coaxial alignment with the entrance and exit apertures 78 and 79 of curing station 70. One of the rollers 89 is fixedly connected to and for rotation with a shaft 90 which is driven by a motor 91 while the roller 89 mounted to the other shaft is an idler roller.

The front and rear sides of the frame which defines the top of the platform for the control and discharge station 95 are flanked by two parallel, horizontally extensible, interconnected arms 86 which are releasably connected thereto by conventional means an example of which is clearly evidenced in FIG. 1 of the drawings, in a manner to enable a quick, selective, horizontal adjustment thereof, as and when required. The degree of the extension of said arms, which will determine the spacing of the rollers 89 from the exit aperture 79 of the curing station 70, will vary dependent on the length of the handles which are being processed at any given time. When the platform forming the base of station 95 is properly set, the right angled extremities formed on the projected end portions of the flanking arms will abut and may be releasably fixed to and in connection with the adjacent side wall of the curing cabinet which has therein the exit aperture 79. These arms are stabilized by a narrow bridging integrated metal strip 84 which is perpendicular thereto and located in a relatively adjacent spaced parallel relation to the end portions thereof which abut the adjacent wall of the curing cabinet. Mounted to a laterally centered portion of each of the strip 84 and the following spaced parallel side portions of the frame mounting the rollers 89, at the side of each thereof remote from the curing cabinet, is a Y-shaped support 85 the divergent arms of which are axially aligned and at a level to receive, support and guide a handle exiting from the curing chamber by way of the aperture 79 and render it stable and maintain its alignment as it moves outwardly of the curing chamber to and between rollers 89. As a handle enters the space between the rollers 89, they positively grip and direct a controlled discharge thereof from the invention system illustrated in the drawings.

Suitable means are provided to enable the adjustment of the spacing of rollers 89 so it will conform and be complementary to the circumferential configuration and transverse dimension of such devices as may be processed at any given time.

Note should be taken of the fact that the speed at which the motor 91 drives its interconnected shaft 90 and the rotor 89 in connection therewith will be greater than the speed at which the pulleys 16 and, correspondingly, belts 14 and rollers 31 are driven. As will be further described, this enables a leading handle H to be accelerated in its movement through the invention system at such time the trailing end thereof is moving to and through plate 87. This is significant in that it produces an instantaneous advance and spacing of the leading handle H from the leading end of the immediately following handle and facilitates an optimal function thereon of the air jets issuing from plate 37 and the uniform achievement of an end product having a substantially uniform distribution of coating material on the leading end as well as along and coextensive with the length thereof.

In the use of the above described system with the coating of handles of the type referred to, the endless belts 14 defining the channel 12 will receive a supply of handles in immediate succession, one at a time and each successive handle will drop at such time the channel 12 is clear of the preceding handle. In the practice of the process of the invention the handle initially deposited in channel 12 will be advanced at a uniform speed by the belts 14, in correspondence with the speed of their movement. Immediately of the advancement of the lead handle H, it enters and passes through the aligned tubular projection 27 in connection with frame 21, to move to and through the aperture 25 and into and between rollers 31 which are being driven at the same speed of rotation as pulley 16. The movement of the lead handle is continuous and as it moves into the grooves at the periphery of the rollers 31 it is positively gripped thereby, whereupon to lend it an inherent balance, further support, precise containment thereof and a supplemental driving influence which advances it sufficiently to carry it to and through the curing station 70 to the discharge station 95. Note that belts 14 serve a complementary advancing function in reference to each handle until such time its trailing end is clear of belts 14. Thus, handle H will be fully balanced as it moves from rollers 31 to and through the aperture 41 of plate 32 to commence its entrance to and passage through the coating chamber which follows.

Note also that the material required in the coating chamber at any given time will be delivered thereto from a source of supply provided in a superposed container 66, by way of a delivery line 65.

On passing through aperture 41, the lead end of this lead handle will have the center thereof in coaxial alignment with the aperture 61 in that part of the elastomer strip 33 forming the adjacent side wall of the coating chamber, the limits and volumetric capacity of which is determined by the thickness of plate 34 and the dimension of its aperture 42. Since the material of strip 33 is not only resilient and flexible but to a degree stretchable, as the lead end of the handle is advanced against the strip 33, the drive thereof forces that portion of the strip 33 which it encounters inwardly of the chamber defined between the elastomer strips 33 and 35. As the lead end of the handle is driven through the small aperture 61 in line therewith, it expands this aperture and causes the material of strip 33 immediately bounding this aperture to form a short sleeve which applies itself in a closely encompassing relation to the exterior surface of the handle as it passes therethrough. As a result thereof, this sleeve serves to provide a very effective wiping function which strips dust and dirt from the handle, throughout its length.

As the domed end of the leading handle enters and the handle moves through the bath of material to which it is subjected in the coating chamber, this material, in this instance an acrylic resin, will surround and the immediately surrounding portion thereof will adhere to the exterior surface of the handle. The diameter of the aligned exit aperture 62 in strip 35, which is of the same material as strip 33, is in this case somewhat smaller than the entrance aperture 61. As the lead end of the handle is forced through aperture 62, the elastomer material immediately bounding the same is stretched to form a sleeve which is somewhat longer than that provided at the entrance to the coating chamber. As the handle moves outwardly from the coating chamber, this latter sleeve is effective to induce the coating material then adherent thereto to be that limited and uniformly spread over the length thereof to produce thereon a very thin protective essentially uniform coating of such material and direct the excess material stripped therefrom back to the container 66. In a preferred practice of the invention, it has been found that in the use of such a construction for the exit of the coating chamber, one may readily achieve a smooth thin coating on the handle which is at this point, as is preferable, in the range of about 0.003–0.006".

Of course, both the leading and trailing ends of the handle will have coating material adhere thereto in passage thereof through the coating chamber. In this respect the leading domed portion of the handle will have an excess thereon, which excess as the handle is advanced towards plate 37 will be met by convergent air jets issuing from bores 68 thereof, the effect of which jets are to essentially uniformly distribute and spread such excess to form a like coating of the dome and disperse any excess material, which will drop into a suitable receptacle for the recycling thereof to the container 66 from which coating material is passed to the coating chamber.

The handle is then advanced to pass it to and force it through the central aperture 44 of plate 37 and the aligned small aperture 63, the latter of which is stretched thereby, inducing the immediately bounding portion of the elastomer material of strip 38 to form a sleeve about and in closely encompassing relation to the body of the handle, which in this instance, in the particular process illustrated, strips the 0.003–0.006" layer of the coating material first effected in exit of the handle from the coating chamber down to one which is very thin and uniform and within a range of about 0.0015 to 0.002" yet fully protective of the handle which it now encases. Such coating material as is stripped will be suitably directed to that receptacle in which previously stripped coating material has been deposited, for similar recycling and use. At this point the leading end of the lead handle H is immediately of the curing station and still moving under the driving influence of the counter-rotating discs 31 which are powered by motor M.

The movement of the lead handle is thus continued to and through and outwardly of the cabinet defining the curing station, in the process of which to enter the curing station by way of aperture 78 and exit therefrom by way of discharge aperture 79. In the course of its passage through the curing station, the relative diagonal disposition of the paired ultraviolet lamps 82 is such to concurrently and mutually function at one and the same time to evenly, quickly and fully cure the acrylic resin coating about and along the length of handle H to which they are applied to establish such coating in a most securely attached essentially integrated connection therewith. The ability to achieve a coating of a handle or other object such as described which is not only smooth and uniform but also highly protective yet coextensively very thin lends itself to optimal curing thereof in a small compact curing chamber. The function of the blower B in the course of the passage of the handle through the curing station has been previously described. As the handle commences its exit from the curing station, the lead and following portions thereof successively move through the divergent portions of the Y-shaped supports 85 by which they are supported and maintained in a precisely aligned relation with the space between rollers 89. Note in FIGS. 2 and 3 that the length of the handle being coated in this instance is somewhat greater than the distance between the entrance to the coating chamber and the point of its discharge by rollers 89. As previously described, immediately as the lead end portion of the lead handle H moves between rollers 89, these rollers which grip the handle and are driven at a speed faster than rollers 31 produce an acceleration of the lead handle so that suddenly it achieves an end spaced relation to the following handle H, at that point that the domed leading end of the immediately following handle exits from the coating chamber, so it too may have the full benefit of the most effective application thereto of the air jets directed through and issued from plates 37.

As mentioned previously, in the application illustrated the handles to be coated are deposited in channel 12 and moved forward for processing in immediately successive, essentially end abutting, relation so that to the point of its described acceleration the trailing end of any leading handle will have abutted thereto the lead end of the trailing handle.

It should also be obvious the nature and form of the multi-apertured strips 33, 35 and 38 of elastomer give these strips long life in view of the fact a simple vertical adjustment of the strips may be easily and readily effected to move any of the apertures therein, to position coaxial the central apertures in the plates forming part of the coating station as and when deemed necessary.

It should be well evident from the foregoing that the process, practice, system and apparatus of the invention and its components have been so contrived that they are most simplistic and efficient in nature, assured as to their performance and their production of high quality end products. As a matter of fact, particularly in the broom, brush and mop industry, they have in test been proven to expedite the production of most satisfactorily coated handles which will not only be more durable and lasting from a utilitarian standpoint but lend appeal to the consumer products of which they form a part. This is apart from the fact that quality coated handles are produced in a minimal of time and at a most reasonable cost. Advance in the art achieved by the present invention is inherent, moreover, in the most compact nature of an installation pursuant to its precepts, thereby saving space and in particular, by the nature of the invention, saving energy.

It will of course be obvious that the composition of the elements of the coating station and the curing station, apart from their most efficient and satisfactory interrelation, are in themselves a contribution to the art to which the invention applies. Another point that should be clear is that the elements of an installation pursuant to the invention as herein set forth have been described and illustrated only with reference to those features and components and their interrelation which are necessary for the understanding of the invention. It is self-evident, of course, that the method may be practiced and the apparatus caused to function in an automatized fashion in its entirety. Such is contemplated within its frame of reference.

Thus, the invention has accomplished all of the objectives previously set forth and fully comprehends a wide range of its practice, embodiments and components thereof which lends a material contribution to that art to which it particularly relates.

From the above description it will be apparent that there is thus provided a process, system and apparatus of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiment of the invention in which an exclusive property or privilege is claimed are defined as follows:

1. A process for protectively coating longitudinally extending rod and bar-like objects, particularly objects such as wooden handles for brooms, brushes and mops, comprising the steps of depositing such objects, at a receiving station, on powered belt means, in a substantially immediately following, end spaced, series relation, applying power to said belt means and maintaining said relation of said objects thereto while moving them to, into, through and beyond a coating station, reinforcing the support and said movement of said objects in, through and beyond said coating station by applying drive means thereto immediately of their entry to said coating station, effecting the adherence of coating material to said objects during the passage thereof through said coating station, smoothly spreading said coating material on said objects as they issue from and are moved beyond said coating station, maintaining power on said drive means and producing a continuing advance of said objects to and through a drying chamber and into a following discharge station, within said discharge station applying a further drive means to said objects in a manner to accelerate the advancing movement thereof and produce thereby an increase in the end spaced relation of the object which is so accelerated from the following of said series related objects at that point in time at which the leading end of said following object is exiting from said coating chamber, thereby to insure the aforesaid smooth spreading of said coating material on said objects as they issue from and are moved beyond said coating station.

2. A process as in claim 1 characterized by applying convergent air jets to the leading end of each of said objects at such times as it is exiting from said coating chamber to smoothly spread coating material thereon and disperse any excess material therefrom for its reuse.

3. A process as in claim 1 including, at a point following the smooth spreading of the layer of coating material first effected on said objects in exit thereof from said coating chamber, the step of stripping such layer down to one the thickness which is rendered very thin and uniform yet fully protective of the object which it encases.

4. A process as set forth in claim 1 including peripherally bracketing said objects with ultra violet light along the length thereof during the course of their movement through said drying station.

5. A process as set forth in claim 4 characterized by maintaining a continuing support and alignment of said objects with each other and said further drive means in said discharge station during the continuing advance of said objects from said receiving station to and through said coating and drying chambers and into said discharge station.

6. A process as in claim 5 wherein said objects are maintained in an essentially end abutted relation prior to the acceleration of that object which is the lead handle being engaged for discharge thereof by said further drive means.

7. A process as set forth in claim 1 wherein the step of depositing such objects, at a receiving station, on powered belt means, in a substantially immediately following, end spaced, series relation, is carried out by nesting said objects in the first instance between side by side longitudinally extended, powered continuous belt means the composite of which is substantially V-shaped in cross section, effecting a lateral containment of the length of each handle, during the movement thereof to, into and through said coating chamber, at least in part.

8. A process for protectively coating longitudinally extending rod and bar-like objects, particularly objects such as wooden handles for brooms, brushes and mops, comprising the steps of depositing such objects, in a receiving station, in a substantially immmediately following series relation, between side by side longitudinally extended endless belt means the composite of which is substantially V-shaped in cross section, effecting a lateral nested containment of the length of each said object which is deposited between said belt means, commonly powering said belt means to move said objects into and through a coating station, while maintaining a support of their length, at least in part, complementing the support and said movement of said objects in, through and beyond said coating station by applying drive means thereto immediately of their entry to said coating station, effecting the adherence of coating material to said objects during the passage thereof through said coating station, smoothly spreading said coating material on said objects as they issue from and are moved beyond said coating station, maintaining power on said drive means and producing a continuing advance of said objects and immediately of the smooth spreading of said coating means, in the course of a continuing advancing movement thereof subjecting said objects to an application of heat of ultra violet lamps immediately peripheral thereto and without delay maintaining the advancing movement thereof, without change of speed, to following discharge station.

9. A process as in claim 8 characterized by the further step of applying a further drive means to said objects as they successively move into said discharge station to accelerate the advancing movement thereof and produce thereby a spaced relation of that object which is so accelerated, in the course of its discharge, from the following of said series related objects, at that point in time at which the leading end of said following object is exiting from said coating chamber, thereby to insure the aforesaid smooth spreading of said coating material on said objects as they issue from and are moved beyond said coating station.

10. A process for protectively coating longitudinally extending rod and bar-like objects, particularly objects such as wooden handles for brooms, brushes and mops, as in claim 8 characterized by commonly powering and driving said endless belt means and the immediately following drive means at the same speed and maintaining a continuous direction and stabilty of said objects thereby.

* * * * *